US006923126B2

(12) United States Patent
Verkley

(10) Patent No.: US 6,923,126 B2
(45) Date of Patent: Aug. 2, 2005

(54) DROP LEAF SUPPORT APPARATUS

(75) Inventor: Michael B. Verkley, Cedar Grove, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 200 days.

(21) Appl. No.: 10/238,133

(22) Filed: Sep. 10, 2002

(65) Prior Publication Data

US 2004/0045487 A1 Mar. 11, 2004

(51) Int. Cl.[7] ..... A47B 1/04
(52) U.S. Cl. ..... 108/80; 108/77
(58) Field of Search ..... 108/77, 80, 81, 108/82, 132, 133, 131; 248/188; 292/370

(56) References Cited

U.S. PATENT DOCUMENTS

| | | | | | |
|---|---|---|---|---|---|
| 133,487 | A | | 11/1872 | Rehfuss | |
| 232,973 | A | * | 10/1880 | Jackson | 108/80 |
| 245,184 | A | * | 8/1881 | Locke | 108/80 |
| 301,014 | A | | 6/1884 | Shuler | |
| 1,842,954 | A | * | 1/1932 | Anderson | 248/240 |
| 2,031,759 | A | * | 2/1936 | Casper | 108/81 |
| 2,035,718 | A | * | 3/1936 | Henry | 108/79 |
| 2,284,003 | A | * | 5/1942 | Luppert | 108/81 |
| 2,314,144 | A | * | 3/1943 | Hicks | 108/81 |
| 2,316,447 | A | | 4/1943 | McFall | |
| 2,318,945 | A | * | 5/1943 | Johannsen | 108/133 |
| 2,329,293 | A | * | 9/1943 | Predit, Jr. | 108/81 |
| 2,352,837 | A | | 7/1944 | Hillenbrand | |
| 2,835,522 | A | | 5/1958 | Serto | |
| 2,872,260 | A | * | 2/1959 | Walter | 108/81 |
| 3,662,694 | A | | 5/1972 | Mitchell | |
| 3,945,328 | A | | 3/1976 | Hendrickson et al. | |
| 4,027,600 | A | | 6/1977 | Mueller | |
| 4,133,271 | A | | 1/1979 | Carlson | |
| 4,844,398 | A | | 7/1989 | Konkle | |
| 5,549,051 | A | * | 8/1996 | Zimmerman | 108/81 |
| 5,941,181 | A | * | 8/1999 | Hornberger et al. | 108/133 |

FOREIGN PATENT DOCUMENTS

| | | | | | |
|---|---|---|---|---|---|
| FR | 2612383 | A1 | * | 9/1988 | A47B/1/05 |
| GB | 2182846 | A | * | 5/1987 | A47B/1/04 |

* cited by examiner

*Primary Examiner*—Jose V. Chen
(74) *Attorney, Agent, or Firm*—Barnes & Thornburg LLP

(57) ABSTRACT

An apparatus is provided for use with a movable section that is coupled to a structure for movement relative to the structure between a use position and a storage position. The apparatus comprises a first arm pivotally coupled to the movable section and a second arm pivotally coupled to the first arm. The apparatus further comprises a latch coupled to the movable section for pivoting movement between a latched position preventing movement of the movable section from the use position to the storage position and a released position allowing movement of the movable section from the use position to the storage position.

36 Claims, 8 Drawing Sheets

DROP LEAF SUPPORT APPARATUS

BACKGROUND

The present disclosure relates to a drop leaf support apparatus that supports a drop leaf or other type of pivotable section in a use position relative to another structure to which the pivotable section is coupled.

Tables, desks, carts, and other types of furniture sometimes have leaves to increase the surface area for supporting objects. Some leaves, known as drop leaves, are pivotable about a horizontal axis between a use position and a storage position. In addition, shelves or other panels are sometimes coupled to walls or other support structures for pivoting movement about respective axes between use positions and storage positions. Various types of support mechanisms are known for supporting drop leaves and movable sections in a use position. See, for example, U.S. Pat. No. 4,844,398.

SUMMARY

According to this disclosure, an apparatus is provided for use with a movable section that is coupled to a structure for movement relative to the structure between a use position and a storage position. The apparatus comprises a first arm pivotally coupled to the movable section and a second arm pivotally coupled to the first arm. The apparatus further comprises a latch coupled to the movable section for pivoting movement between a latched position preventing movement of the movable section from the use position to the storage position and a released position allowing movement of the movable section from the use position to the storage position.

According to an illustrative embodiment, the first arm is coupled to the second arm for pivoting movement about a first pivot axis and the latch is coupled to the movable section for movement about a second pivot axis which is parallel with the first pivot axis. Illustratively, the first and second arms pivot about the first pivot axis between an in-line configuration in which the movable section is supported in the use position and a folded configuration in which the movable section is in the storage position. In an illustrative embodiment, a first biaser is provided to retain the first and second arms in the in-line configuration and a second biaser is provided to bias the latch toward the latched position. In an illustrative embodiment, a catch is coupled to the first arm. The catch engages the latch to prevent the first and second arms from moving toward the folded configuration. An illustrative catch comprises a pin that extends from the first arm.

According to an additional aspect of this disclosure, a ring and cover member is coupled to the first and second arms. In an illustrative embodiment, the ring and cover member is coupled to the first and second arms for pivoting movement about the first pivot axis. To move the movable section from the use position to the storage position, a user moves the latch against the bias of the second biaser from the latched position to the released position and then the user pulls the ring downwardly to overcome the bias of the first biaser to move the first and second arms from the in-line configuration to the folded configuration.

In the illustrative embodiment, the first arm is coupled to the movable section for pivoting movement about a third pivot axis and the second arm is coupled to the structure for pivoting movement about a fourth pivot axis. The third and fourth pivot axes are parallel with the first pivot axis. Also in the illustrative embodiment, a biaser is coupled to the first and second arms to bias the first and second arms toward the in-line configuration when the first pivot axis is above a line defined by the points at which the biaser connects to the first and second arms and to bias the first and second arms toward the folded configuration when the first pivot axis is below the line defined by the points at which the biaser connects to the first and second arms. Thus, the first and second arms are configured as an overcenter linkage.

Additional features will become apparent to those skilled in the art upon consideration of the following detailed description of illustrative embodiments exemplifying the best mode of carrying out the drop leaf support apparatus as presently perceived.

BRIEF DESCRIPTION OF THE DRAWINGS

The detailed description particularly refers to the accompanying figures, in which.

DETAILED DESCRIPTION OF THE DRAWINGS

Figure 1:
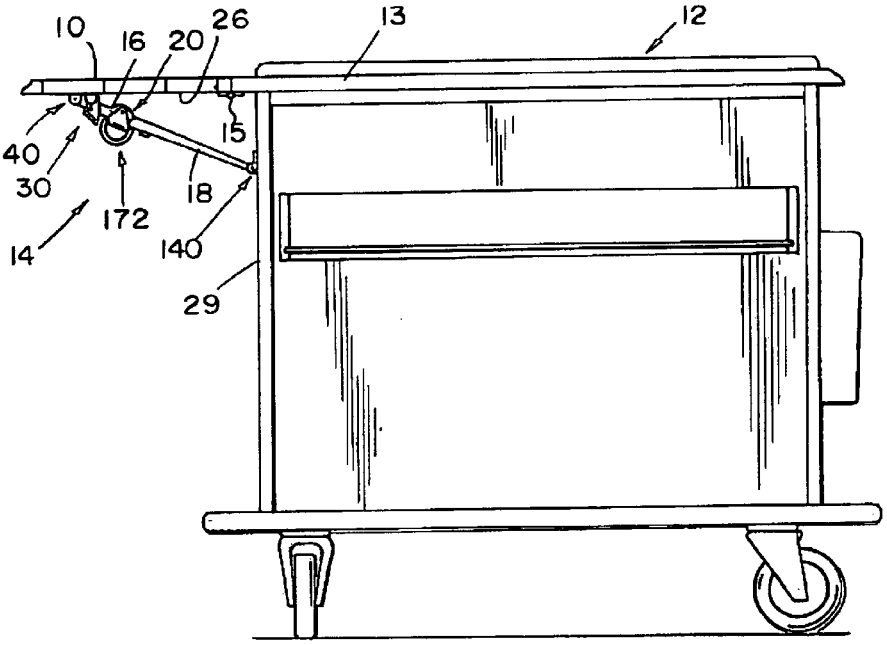
FIG. 1 is a side elevation view of an illustrative cart showing a pivotable table section of the cart supported by a support assembly in a use position relative to a main table section of the cart.
Figure 4:
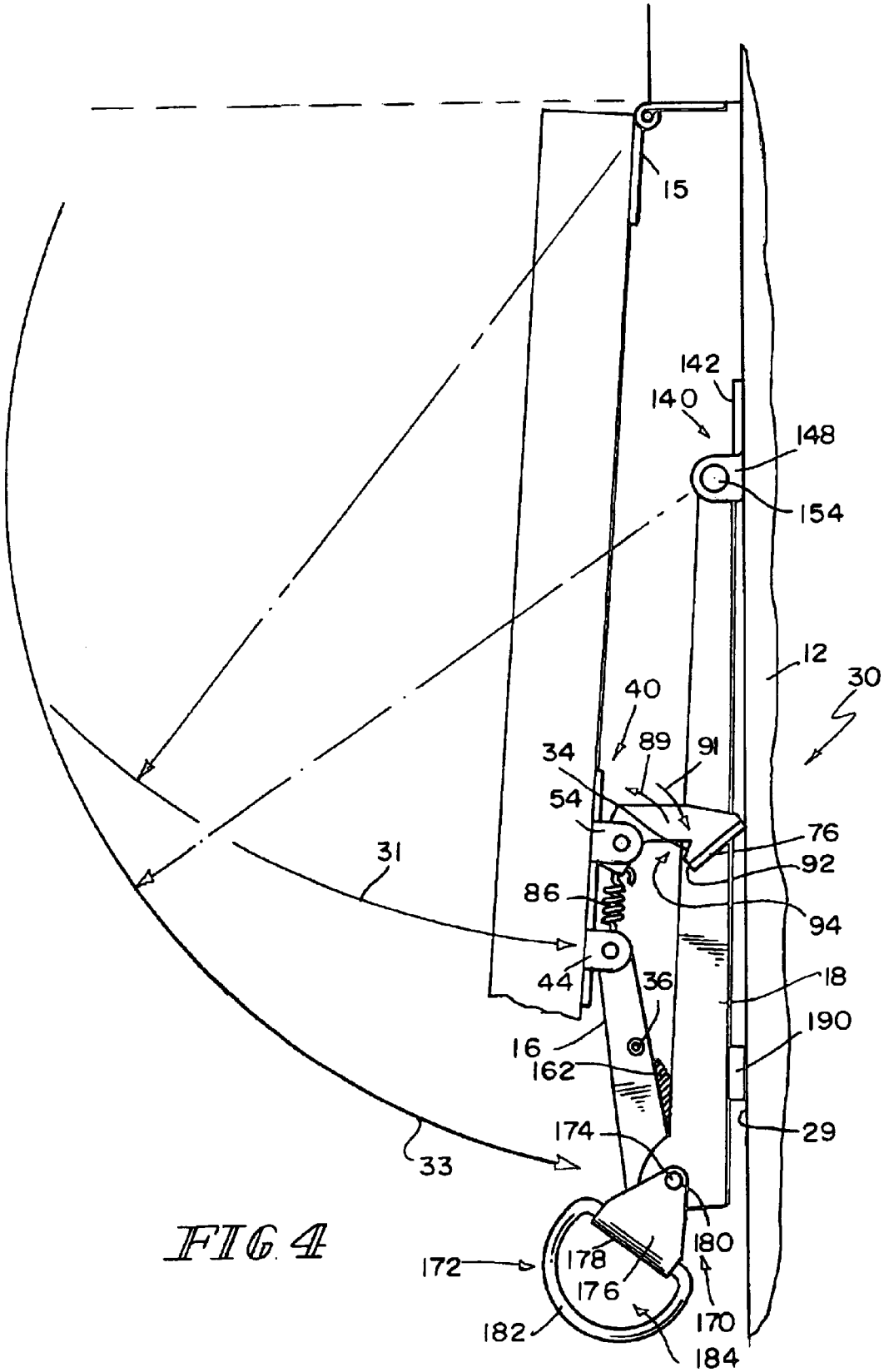
FIG. 4 is a side elevation view of a portion of the cart showing the pivotable table section in a storage position and showing first and second arms of the support assembly in a folded configuration.

According to this disclosure, a cart 12 has a main table section 13 and a movable section or drop leaf 10 coupled to main table section 13 for movement between a use position, shown in FIG. 1, and a storage position, shown in FIG. 4. Movable section 10 pivots relative to main table section 13 and is supported in the use position by a support assembly 14. Illustratively, movable section 10 is pivotally coupled to cart 12 with one or more hinges 15. Support assembly 14 includes a first arm 16 movably coupled to a second arm 18 at a junction 20 adjacent first ends 22 of each of arms 16, 18. First arm 16 has a second end 24 pivotally coupled to a mounting bracket 40 which, in turn, is coupled to a mounting surface 26 of movable section 10. Second arm 18 has a second end 28 coupled to a mount 140 which, in turn, is coupled to a vertical wall 29 of cart 12. To move movable section 10 to the storage position, as shown in FIG. 4, first and second arms 16, 18 are pivoted relative to each other and folded. Thus, in the illustrative embodiment, arms 16, 18 are configured as an overcenter linkage and are movable from an in-line configuration to a folded configuration.

As shown in FIGS. 1–5, support assembly 14 further includes a latch 30 to inhibit movement of movable section 10 from the use position. Latch 30 is coupled to mounting bracket 40. Latch 30 moves between a latched position, shown in FIGS. 1, 2, and 4, and a released position, shown in FIG. 3A. In the latched position, an engagement surface 34 of latch 30 is in a path of a catch 36 that extends from first arm 16. If a user attempts to move support assembly 14 and movable section 10 to the storage position when latch 30 is in the latched position, engagement surface 34 engages catch 36 to limit the amount by which section 10 is able to move from the use position. When latch 30 is in the released position, as shown in FIG. 3A, engagement surface 34 is out of the path of catch 36 so that movable section 10 and support assembly 14 can be moved to the storage position.

Figure 5:
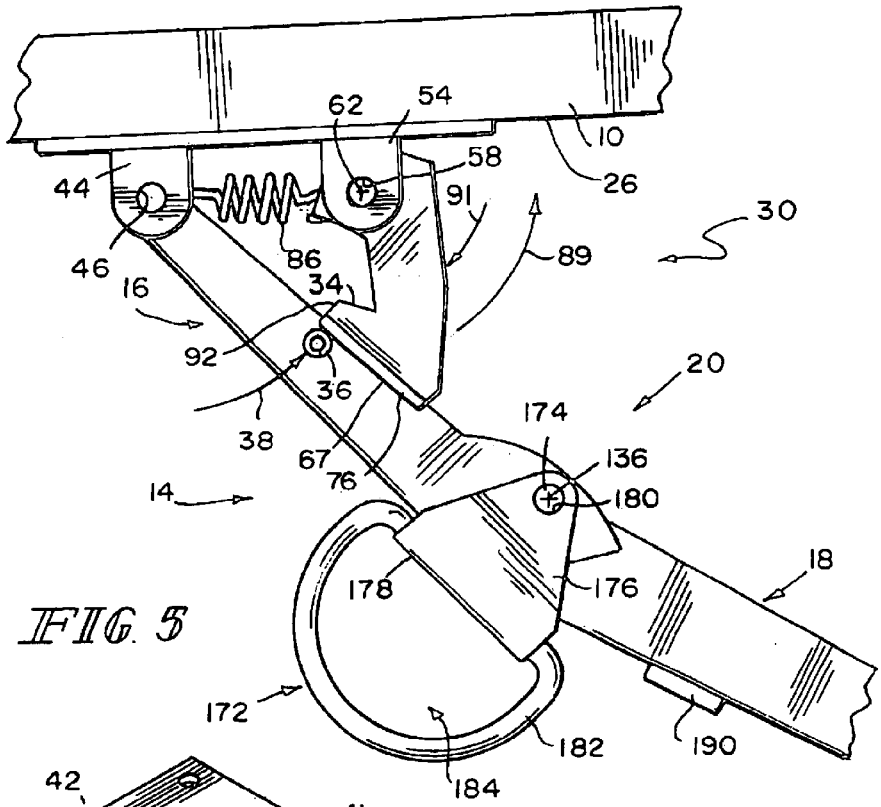
FIG. 5 is a side elevation view of a portion of the cart showing the catch engaging a cam surface of the latch as the pivotable table section is pivoted upwardly toward the use position so that the latch moves to clear the catch and permit the pivotable table section to be moved to the use position.
Figure 6:
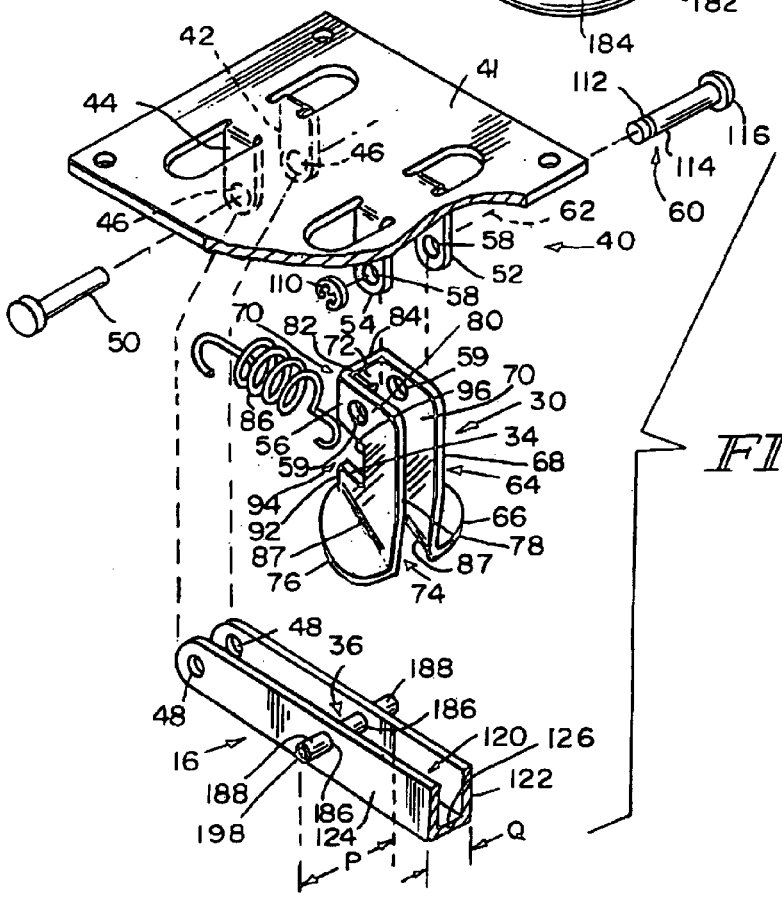
FIG. 6 is an exploded perspective view of a portion of the support assembly showing a mounting bracket having a first pair of flanges to which the first arm couples and having a second pair of flanges to which the latch couples.

As shown in FIGS. 1–4, first arm 16 and latch 30 are both coupled to mounting bracket 40. Mounting bracket 40 includes a pair of spaced-apart first flanges 42, 44 between which end 24 of first arm 16 is situated. As shown in FIG. 6, each flange 42, 44 is formed to include a hole 46 that is aligned with a hole 48 through second end 24 of first arm 16. A retainer, such as rivet 50, is inserted through holes 46, 48 to pivotally couple first arm 16 to mounting bracket 40. As best shown in FIGS. 2–6, mounting bracket 40 includes a pair of spaced-apart second flanges 52, 54 between which a first region 56 of latch 30 is situated. As best shown in FIG. 6, each flange 52, 54 is formed to include a hole 58 that is aligned with a hole 59 in first region 56 of latch 30. A retainer, such as a latch pin 60, is inserted through holes 58, 59 to pivotally couple latch 30 to mounting bracket 40. Latch 30 pivots about a latch pivot axis 62 extending longitudinally through latch pin 60. It is within the scope of this disclosure to eliminate mounting bracket 40 and to couple the arm(s) and/or the latch directly to movable section 10.

Figure 7:
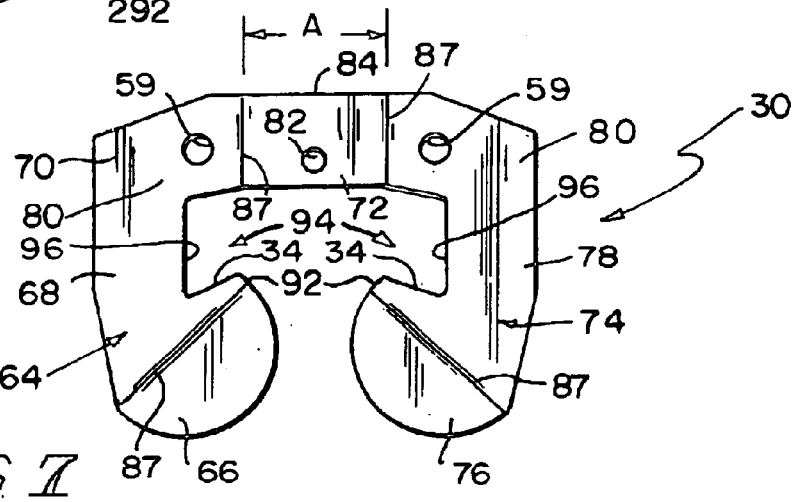
FIG. 7 is a top plan view of a first embodiment of the latch in a preformed state after being stamped or otherwise made from a blank.

As shown in FIG. 7, one embodiment of latch 30 is stamped or otherwise made as a single, somewhat U-shaped piece in its unformed state. Latch 30 is molded, bent, folded, or otherwise moved to the formed position shown in FIG. 6. In the unformed state, latch 30 is generally planar and includes a first arm 64 having, at one end, a rounded finger grip 66, a generally straight mid section 68, and at the other end of first arm 64 a coupling region 70 formed to include one of holes 59 for pivotally coupling latch 30 to mounting bracket 40. A bight 72 couples to the coupling region 70 of first arm 64 a second arm 74 that is illustratively a mirror-image of the first arm 64. Second arm 74 includes at one end a rounded finger grip 76, a generally straight mid section 78, and at the other end of second arm 74 a coupling region 80 formed to include one of holes 59 for pivotally coupling latch 30 to mounting bracket 40. Bight 72 is formed to include a hole 82 that receives an end of a latch spring 86 which biases latch 30 to the latched position.

As shown in FIGS. 6 and 7, each finger grip 66, 76 is bent or folded along a fold line 87 so that a portion of each finger grip 66, 76 projects generally perpendicular to mid section 68 and away from the other of finger grips 66, 76. When the embodiment of latch 30 shown in FIG. 7 is bent or otherwise moved into its formed position, shown in FIG. 6, first and second arms 64, 74 are generally parallel and spaced apart by a distance A so that latch 30 fits between flanges 52, 54. Bight 72 has a stop edge 84 that engages mounting bracket 40 to prevent latch 30 from over-rotating past the latched position as shown in FIG. 4.

Figure 3A:
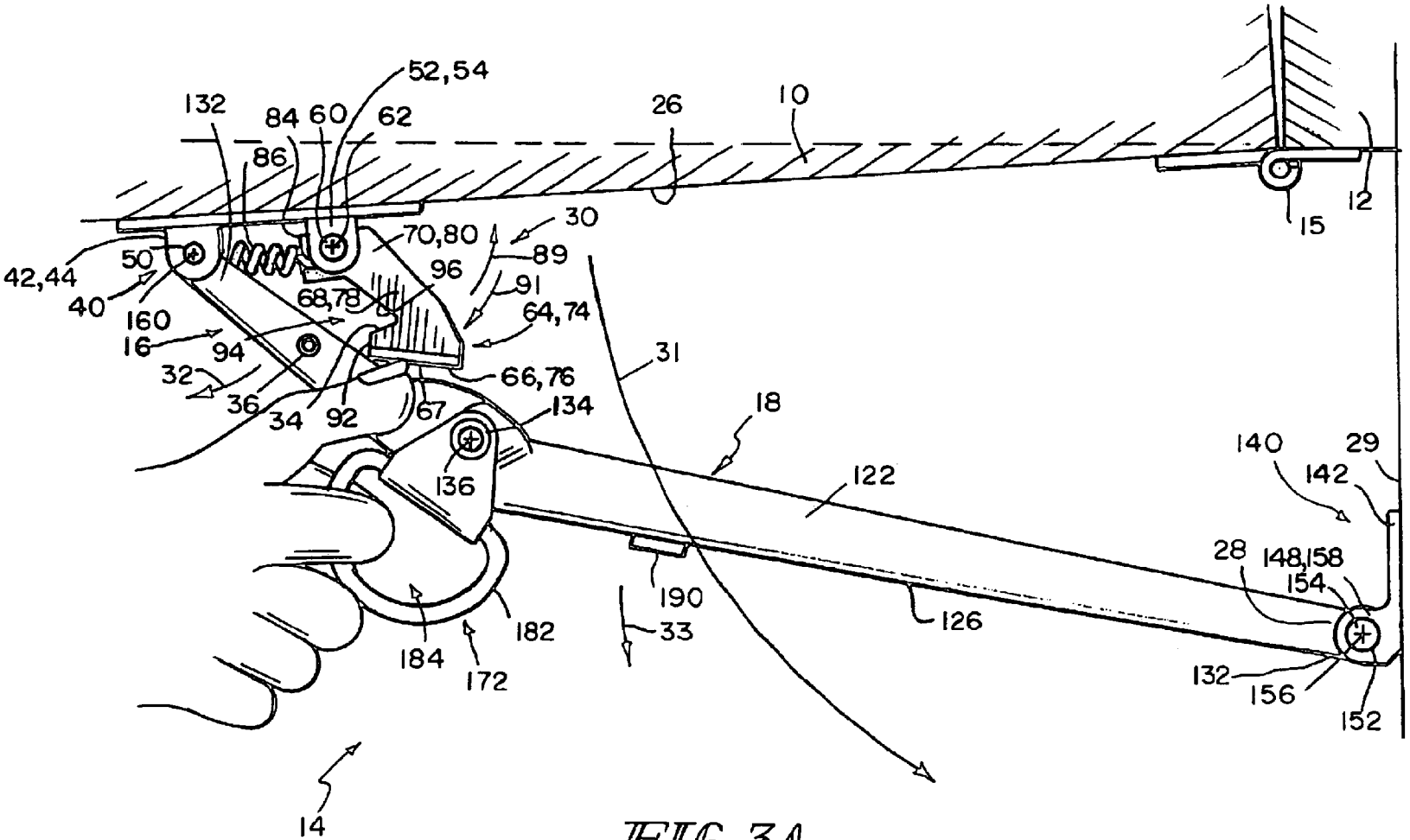
FIG. 3A is a side elevation view of the a portion of the cart, similar to FIG. 2, showing the latch moved to a released position by a user's thumb and showing the handle being pulled downwardly by a user's finger to move the first and second arms out of the in-line configuration.
Figure 3B:
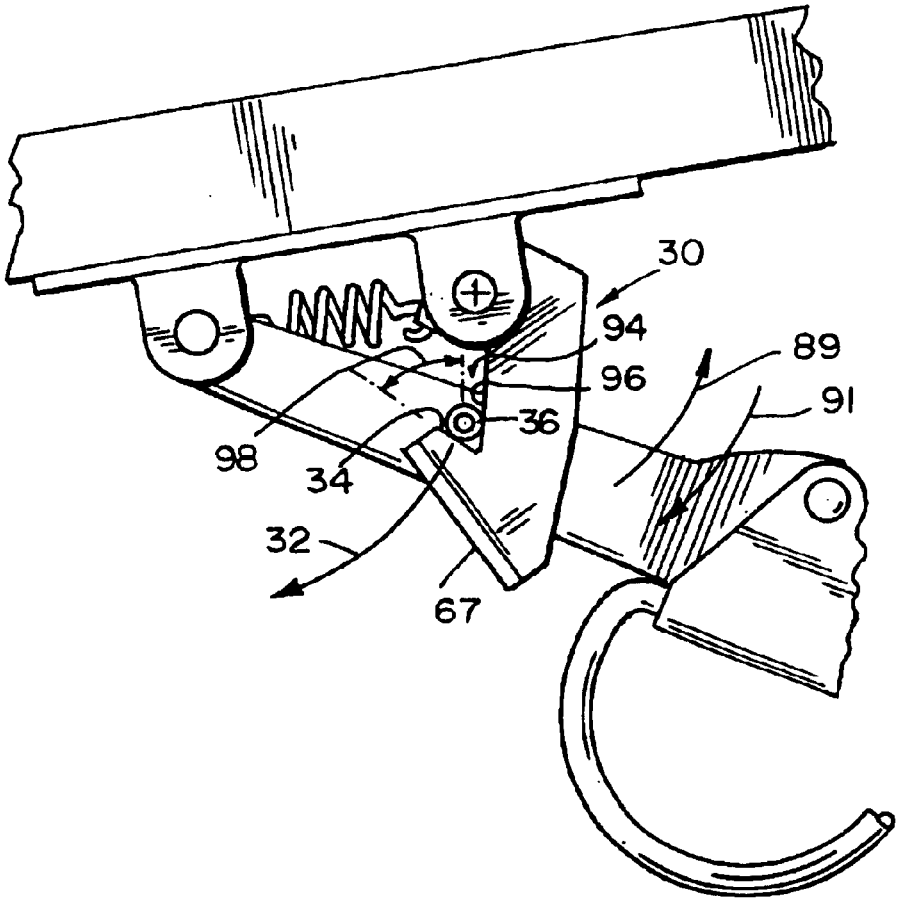
FIG. 3B is a fragmentary side elevation view of a portion of the cart showing the latch in a latched position and showing a catch of the support assembly engaging an engagement surface of the latch to inhibit movement of the pivotable table section toward the storage position.

As shown in FIG. 3A, when a user moves latch 30 from the latched position toward the released position, in a direction indicated by arrow 89, engagement surface 34 pivots about latch pivot axis 62 out of the path of catch 36. Additionally, stop edge 84 moves away from mounting bracket 40 to a position spaced apart from mounting bracket 40 when latch 30 is pivoted in direction 89 out of the latched position. When latch 30 is in the released position, a user can move movable section 10 in direction 31 from the use position toward the storage position. As movable section 10 pivots in direction 31, first arm 16 pivots relative to mounting bracket 40 about an axis 160 in direction 32 and second arm pivots relative to mount 140 about an axis 156 in a direction 33. Also during movement of movable section 10 in direction 31, arms 16 and 18 pivot relative to each other about an axis 136.

Latch 30 moves in a first plane that is defined by the movement of a longitudinal centerline of latch 30 about latch pivot axis 62. First arm 16 moves in a second plane that is defined by the movement of a longitudinal centerline of arm 16 about pivot axis 50. Illustratively, the first plane of movement of latch 30 is parallel to the second plane of movement of first arm 16. Further illustratively, the first plane of movement of latch 30 is coplanar with the second plane of movement of first arm 16.

Figure 2:
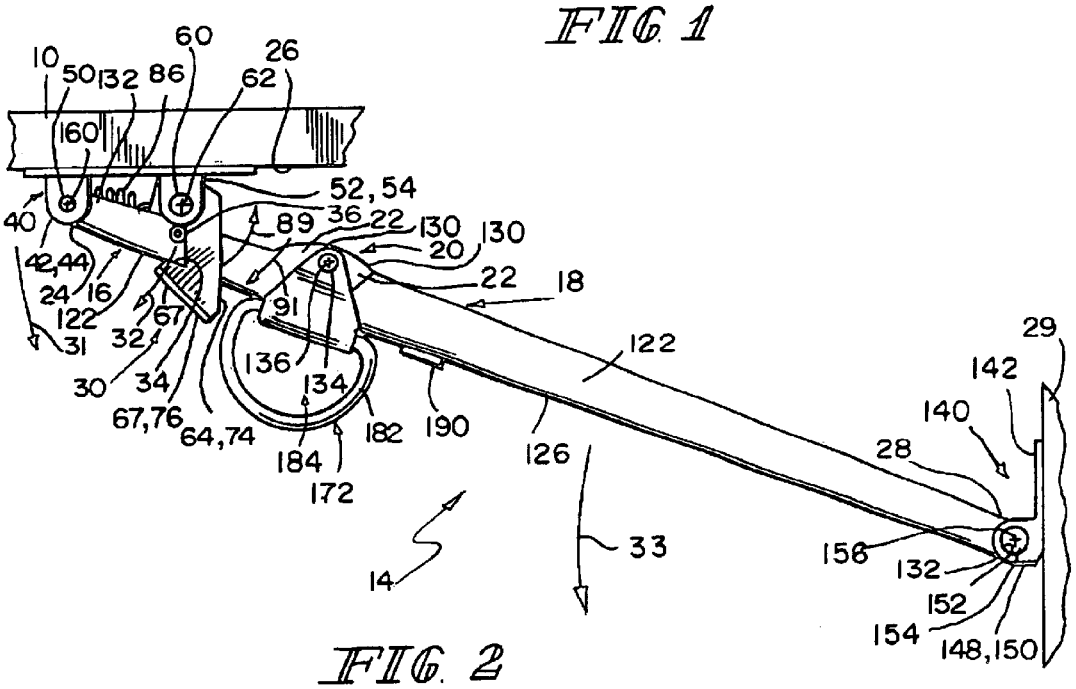
FIG. 2 is a side elevation view of a portion of the cart showing a first arm of the support assembly coupled to a second arm by a pivot pin, the first and second arms being in an in-line configuration to support the pivotable table section in the use position, a handle coupled to the pivot pin, and a latch of the support assembly positioned to the left of the handle.

Latch 30 automatically latches due, in part, to the bias exerted by latch spring 86 on latch 30. When a user releases latch 30, the latch moves in direction 91 to return to the latched position of FIG. 2. As shown in FIG. 5, as a user moves movable section 10 toward the use position, arms 16, 18 move toward their in-line configuration, shown for example in FIG. 2, and catch 36 moves toward latch 30. As catch 36 engages latch 30, catch 36 wipes against a cam surface 67 of finger grips 66, 76, causing latch 30 to move in direction 89 and permitting an end region 92 of each arm 64, 74 to clear the catch 36. Latch 30 then moves back toward the latched position of FIG. 2 until catch 36 is situated in a notch 94 formed between end region 92 and the mid-section 68, 78 of each of first and second arms 64, 74. As shown in FIGS. 1 and 2, when movable section 10 is in its use position edges 96 of arms 64, 74 of latch 30 are biased by spring 86 into engagement with catch 36.

When a user attempts to move support assembly 14 to the folded or storage position of FIG. 4, and latch 30 is in the latched position, catch 36 slides against edges 96 of each arm 64, 74 until catch 36 engages engagement surface 34 inhibiting further movement of movable section 10 and support assembly 14. As shown in FIG. 3A, each engagement surface 34 forms an angle 98 with the associated edge 96. In the illustrative embodiment, angle 98 is an acute angle so that, upon engagement of surface 34 with catch 36, engagement surface 34, catch 36, and edges 96 are urged together and catch 36 remains in notch 94.

Latch 30 is coupled to mounting bracket 40 by aligning holes 58 of flanges 52, 54 and holes 59 of first region 56 of latch 30 and inserting latch pin 60 through the aligned holes as discussed above. Illustratively an e-clip 110 is clipped to latch pin 60 in a groove 112 formed in an end 114 of latch pin 60 projecting beyond flange 54 to hold latch pin 60 in place in holes 58, 59. To prevent inadvertent removal, latch pin 60 illustratively includes a head 116 larger than holes 58. In alternative embodiments, pin 60 is replaced with a rivet, similar to rivet 50.

Figure 8:
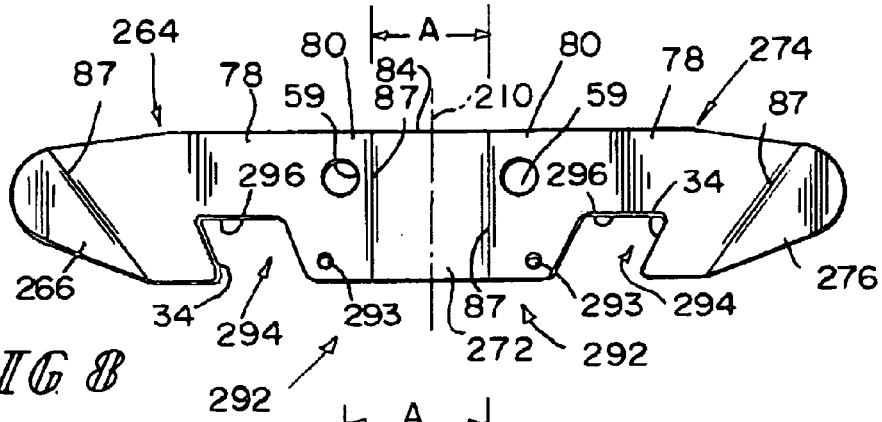
FIG. 8 is a top plan view of a second embodiment of a latch in a preformed state after being stamped or otherwise made from a blank.
Figure 10:
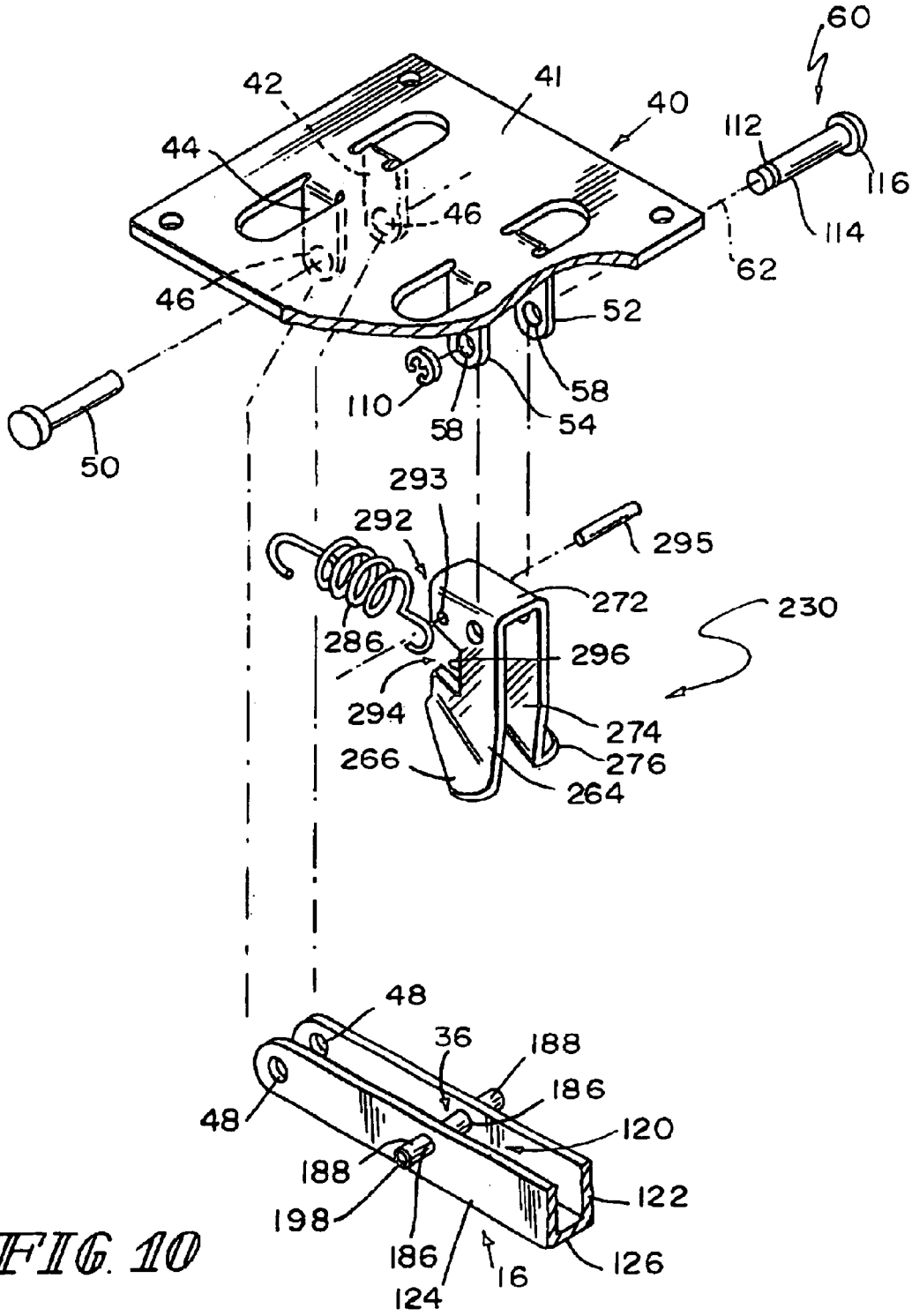
FIG. 10 is an exploded perspective view of the support assembly, similar to FIG. 6, showing the second embodiment of the latch.

Another embodiment of a latch 230 is shown in FIGS. 8 and 10. Latch 230 is similar to latch 30 in form and function, except as noted otherwise herein. As shown in FIG. 8, in its unformed state, latch 230 is illustratively generally oblong, flat, and symmetrical about a transverse centerline 210. Latch 230 is folded or bent into its finished state, as shown in FIG. 10, such that latch 230 is a generally U-shaped structure with generally parallel arms 264, 274 coupled by a bight 272 extending between arms 264, 274. Notches 294 are formed in each of arms 264, 274 by cooperation of rounded finger grips 266, 276 and edges 296. At an end region 292 of arms 264, 274, a spring pin hole 293 is formed in each of arms 264, 274 through which a spring pin 295 is inserted to retain an end of latch spring 286. Spring pin 295 is positioned so that latch pivot axis 62 is between a longitudinal axis through spring pin 295 and mounting bracket 40. Alternatively, spring pin 295 is omitted and one latch spring end is inserted through spring pin hole 293 in one or both latch arms 264, 274. Bight 272 generally faces toward bracket 40 and mounting surface 26 of movable section 10.

Illustratively, mounting bracket 40 comprises a metal material. Flanges 42, 44, 52, 54 are formed from a generally flat metal blank or plate 41 by stamping blank 41 to form generally U-shaped tabs in blank 41. The tabs are then bent to form an angle of about 90 degrees relative to plate 41, forming generally parallel arm flanges 42, 44 and latch flanges 52, 54 that extend away from the mounting surface 26 of movable section 10. Further illustratively, latches 30, 230 each comprise a metal material that is bent from its preformed state, shown in FIGS. 7 and 8, to the formed state shown in FIGS. 6 and 10 respectively. It is within the scope of this disclosure, however, to use other materials to make mounting bracket 40 and latch 30, 230, for example, polymers or the like.

Figure 11:
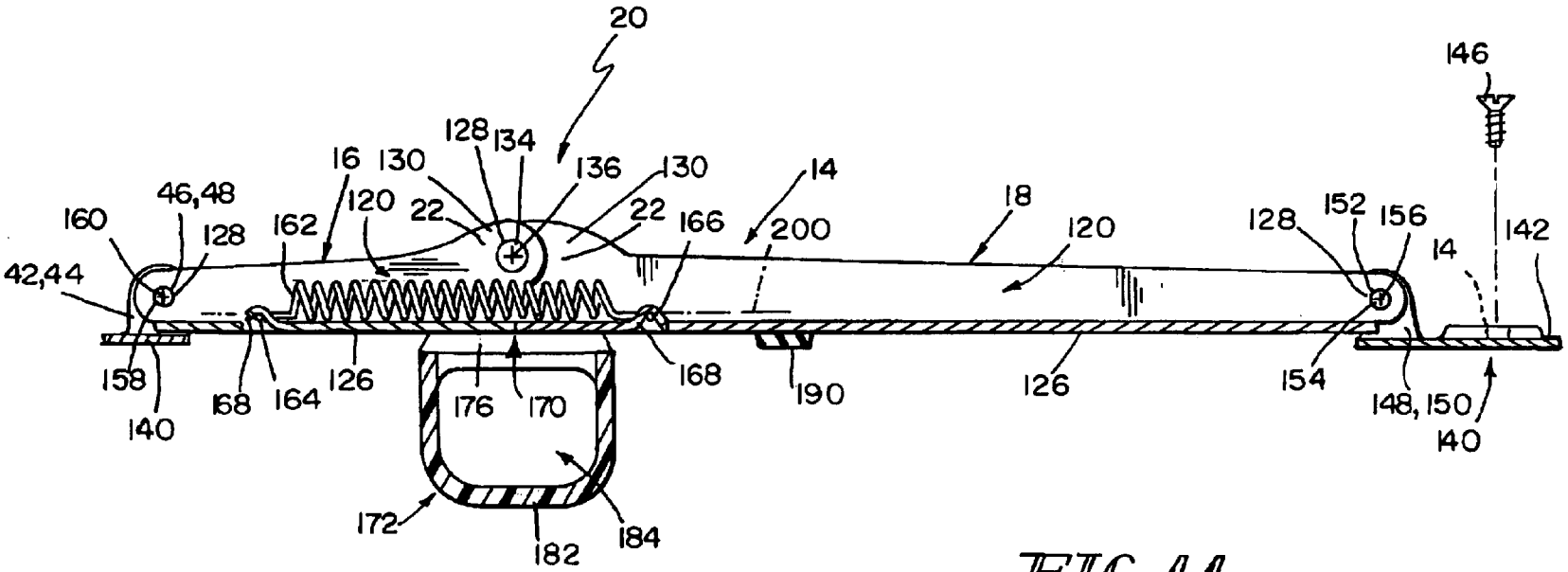
FIG. 11 is a cross-sectional side view of the support assembly taken generally along a longitudinal centerline through the support assembly showing the support assembly without the latch, and the spring coupled to the arms to bias the support assembly to the use position.

As mentioned previously, arms 16, 18 pivot relative to one another about a pivot axis 136 when movable section 10 is moved between the use position and the storage position. Arms 16, 18 each include a channel 120 therein. Channel 120 is defined by upstanding channel walls 122, 124 and channel bottom 126 coupled to and extending between the channel walls 122, 124. Channel walls 122, 124 of both arms 16, 18 are formed to include holes 128 at inner ends 130 and at outer ends 132 thereof as shown in FIG. 11. As shown in FIGS. 1–2, 9 and 11, when movable section 10 is in the use position and arms 16, 18 are in the in-line configuration, channel bottoms 126 of arms 16, 18 abut. Inner ends 130 of walls 122, 124 of first arm 16 are nested between inner ends 130 of walls 122, 124 of second arm 18 so that the holes 128 of both arms 18, 16 align with one another for receiving a fastener, such as rivets 134 therethrough. As shown in FIG. 3–5 and 9, arms 16, 18 are pivotally connected at inner ends 130 to form junction 20. Axis 136 extends through rivets 134 and is the axis about which each of arms 16, 18 rotates or pivots relative to the other. Arms 16, 18 are prevented from pivoting beyond the aligned position shown in FIG. 9 by the abutment of channel bottom portions 126.

Second arm 18 is coupled to mount 140 to permit relative pivoting movement between arm 18 and vertical wall 29 of illustrative cart 12. Mount 140 includes a plate 142 having holes 144 formed therein to receive retainers 146 therethrough to secure mount 140 to cart 12. A pair of generally parallel spaced apart flanges 148, 150 extend from an end of mount 140 opposite plate 142. Each of flanges 148, 150 is formed to include a hole 152 therein to receive a connector such as illustrative rivet 154. Rivet 154 is inserted through aligned holes 128 of outer end 132 and holes 152 in flanges 148, 150. Second arm 18 pivots relative to vertical wall 29 about second arm pivot axis 156 that extends longitudinally through rivet 154. First arm 16 is pivotally coupled to flanges 42, 44 of mounting bracket 40 with a retainer such as illustrative rivet 50. First arm 16 pivots relative to movable section 10 and mounting bracket 40 about first arm pivot axis 160 extending longitudinally through rivet 50. Illustratively, latch spring 86, 286 at one end is coupled to rivet 50. It is within the scope of this disclosure to couple latch spring 86, 286 to another structure, such as mounting bracket 40, movable section 10, or first arm 16.

Figure 9:
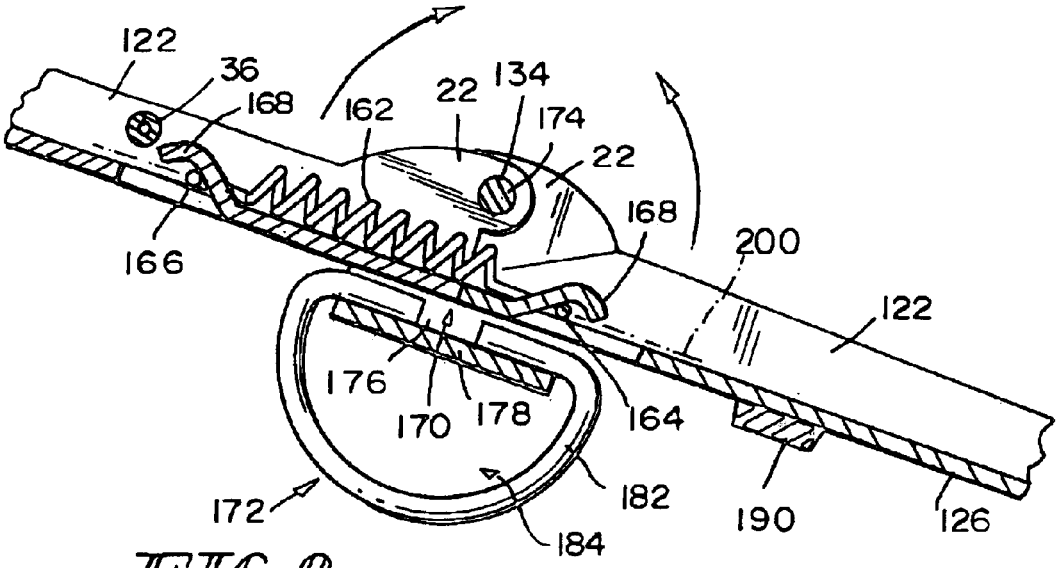
FIG. 9 is a cross-sectional view of a portion of the support assembly taken generally along a longitudinal centerline through the first and second arms showing a spring coupled to the first and second arms to retain the first and second arms in the in-line configuration.

A biaser or biasing member 162 is provided to assist retaining movable section 10 in the use position shown for example in FIG. 1, and to assist in moving the movable section 10 to the storage position of FIG. 4 as the support assembly 14 moves into its folded configuration. Biaser 162 is coupled to first and second arms 16, 18 at connection points which define a line 200 as shown in FIGS. 9 and 11. Line 200 is parallel with the longitudinal dimensions of arms 16, 18. Arms 16, 18 are configured as an overcenter linkage in which biaser 162 biases first and second arms 16, 18 toward the in-line configuration when first pivot axis 136 is above line 200 and in which biaser 162 biases first and second arms 16, 18 toward the folded configuration when first pivot axis 136 is below line 200. Thus, a first rotation zone of arms 16, 18 is defined when axis 136 is above line 200 and a second rotation zone of arms 16, 18 is defined when arms 16, 18 are below line 200.

Illustratively, the biasing member is a tension spring (hereinafter referred to as spring 162) having a first end 164 and a second end 166. A finger 168 is punched into each channel bottom 126 of arms 16, 18 and extends from channel bottoms 126 to lie between channel walls 122, 124. Spring end 164 is connected to finger 168 of arm 16 and spring end 166 is connected to finger 168 of arm 18 so that at least a portion of spring 162 lies in channels 120 of arms 18, 20. As shown in FIGS. 9 and 11, the ends 164, 166 of spring 162 are coupled to fingers 168 below arm pivot axis 136 and above channel bottoms 126. Thus, the tension of spring 162 pulls the fingers toward one another when the arms 16, 18 are in the first rotation zone, pulling the channel bottoms 126 together and into abutment with one another.

As suggested in FIG. 9, when moving support assembly 14 to the folded or storage position, a user "folds" arms 16, 18 from their in-line configuration. Spring 162 is, at first, pulled farther apart as fingers 168 extend farther apart as they pivot about arm pivot axis 136. Thus, when arms 16, 18 are in the first rotation zone, the bias of spring 162 resists pivoting movement of arms 16, 18 away from the in-line configuration. In the second rotation zone, after the ends 164, 166 of spring 162 pass pivot axis 136, and arms 16, 18 are, illustratively, less than about 160 degrees from one another, spring 162 biases arms 16, 18 together to the folded or storage position. Spring 162 so biases arms 16, 18 until the arms are in the storage position shown in FIG. 4.

In the storage position of FIG. 4, a pinch point or region 170 is exposed between arms 16, 18. Pinch region 170 becomes progressively smaller as movable section 12 is pivoted from its storage position to its use position. To aid in preventing a user's fingers from becoming caught within or around pinch region 170, a ring and cover member 172 is provided and is pivotally attached to arms 16, 18 via rivets 134 so as to pivot about arms pivot axis 136. Ring and cover member 172 includes a cover for covering the pinch region 170 between the arms 16, 18 near junction 20. Ring and cover member 172 further includes a handle or ring for a user to grip to push, pull, or otherwise apply force to pivot arms 16, 18 relative to each other about axis 136.

The cover of ring and cover member 172 is U-shaped and has two spaced apart legs 176 coupled to a base portion 178 extending between legs 176. Legs 176 are illustratively flat, triangular, and increasing in size from the pivotal connection about pivot axis 136 towards their connection to base portion 178. Legs 176 have holes 180 through which rivets 134 are received for pivotally attaching legs 176 to walls 122, 124 of arms 16, 18 as shown, for example, in FIG. 3. Base portion 178 is illustratively a substantially flat, rectangular member which, in conjunction with legs 58 covers at least a portion of pinch region 170.

A handle or ring member 182 is coupled to base portion 178 of ring and cover member 172. Ring member 182 defines a finger hole 184. In operation, when "breaking" movable section 10 from its in use position as shown in FIG. 1, a user actuates latch 30, places a finger through finger hole 184, and pulls ring member 182 away from junction 20, causing arms 16, 18 to pivot and movable section 10 to move toward the storage position.

When placing movable section 10 in the use position, a user pushes ring member 182 and/or base portion 178 toward arms 16, 18 causing arms 16, 18 to pivot toward their aligned, use position. Generally, one may also aid the operation of the support assembly 14 by grasping movable section 10 and pulling the it toward its use position.

A bumper 190 is coupled to channel bottom 126 of second arm 18, illustratively adjacent junction 20. Bumper 190 extends from arm 18 a distance sufficient so that no part of second arm 18 engages vertical wall 29, thereby preventing scratching or other damage to the vertical wall 29. As support assembly 14 is moved to the storage position of FIG. 4, bumper 190 extends from channel bottom 126 of second arm 18 a greater distance than latch 30 extends, preventing latch 30 from contacting and damaging vertical wall 29. Bumper 190 is constructed of a material that will not scratch, dent, or otherwise damage vertical wall 29 under the forces experienced in operation. Such materials can include plastics, relatively smooth and non-abrasive metal, rubber, or the like.

Catch 36 is illustratively a rolled pin comprising a generally cylindrical body that is somewhat C-shaped in cross section, as shown in FIG. 9. As shown in FIG. 6, catch 36 has a width P that is greater than a distance Q between channel walls 122, 124 of arm 16. Catch 36 extends through apertures 186 formed in walls 122, 124 so that ends 188 of catch 36 extend outside of channel 120 to be engaged by engagement surfaces 34 of latch 30 or latch 230, as the case may be. Catch 36 has a beveled end 198 to facilitate the insertion of catch 36 through apertures 186. In the illustrative embodiment, catch 36 is press fit into apertures 186. In an alternative embodiment, catch 36 is formed integrally with first arm 16, such as, for example, a tab that is punched out of one or both of walls 122, 124.

Although movable section 10 and support assembly 14 are described herein as being included in cart 12, it is within the scope of this disclosure for movable section 10 and support assembly 14 to be included in other types of furniture such as a table or a desk. In addition, movable section 10 and support assembly 14 may be coupled to a wall, a cabinet, or any other type of structure such that movable section 10 serves as a shelf when in the use position.

Although a drop leaf support apparatus has been described in detail with reference to certain preferred embodiments, variations and modifications exist within the scope and spirit of the invention as described and defined in the following claims.

What is claimed is:

1. An apparatus for use with a movable section that is coupled to a structure for movement relative to the structure between a use position and a storage position, the apparatus comprising a support assembly configured to support the movable section in the use position, the support assembly having a first arm and a second arm coupled to the first arm for pivoting movement about a first pivot axis, and a latch coupled to the movable section for pivoting movement about a second pivot axis between a latched position in which the latch interferes with pivoting movement of the first and second arms thereby preventing movement of the movable section from the use position to the storage position and a released position allowing movement of the movable section from the use position to the storage position, the second pivot axis being parallel with the first pivot axis.

2. An apparatus for use with a movable section that is coupled to a structure for movement relative to the structure between a use position and a storage position, the apparatus comprising a support assembly configured to support the movable section in the use position, the support assembly having a first arm and a second arm coupled to the first arm for pivoting movement about a first pivot axis, and a latch coupled to the movable section for pivoting movement about a second pivot axis between a latched position preventing movement of the movable section from the use position to the storage position and a released position allowing movement of the movable section from the use position to the storage position, the second pivot axis being parallel with the first pivot axis wherein the latch in the latched position engages a catch coupled to one of the first and second arms to inhibit movement of the support assembly from the use position.

3. The apparatus of claim 2, wherein the catch comprises a pin extending from one of the first and second arms.

4. The apparatus of claim 2, wherein the support assembly further comprises a mounting bracket and the latch comprises a first portion having a first end coupled to the mounting bracket and a second end providing an engagement surface to engage the catch and inhibit movement of the movable section from the use position.

5. The apparatus of claim 4, wherein the latch further comprises a second portion that is a mirror image of the first portion and a bight extending between and coupling the first and second portions.

6. The apparatus of claim 1, wherein the support assembly further comprises a mounting bracket having a pair of spaced apart flanges and the latch is pivotally coupled to the pair of flanges.

7. An apparatus for use with a movable section that is coupled to a structure for movement relative to the structure between a use position and a storage position, the apparatus comprising a support assembly configured to support the movable section in the use position, the support assembly having a first arm and a second arm coupled to the first arm for pivoting movement about a first pivot axis, and a latch coupled to the movable section for pivoting movement about a second pivot axis between a latched position preventing movement of the movable section from the use position to the storage position and a released position allowing movement of the movable section from the use position to the storage position, the second pivot axis being parallel with the first pivot axis, wherein the support assembly further comprises a mounting bracket having a second pair of spaced apart flanges and the first arm is pivotally coupled to the pair of flanges.

8. An apparatus for use with a movable section that is coupled to a structure for movement relative to the structure between a use position and a storage position, the apparatus comprising a support assembly configured to support the movable section in the use position, the support assembly having a first arm and a second arm coupled to the first arm for pivoting movement about a first pivot axis, and a latch coupled to the movable section for pivoting movement about a second pivot axis between a latched position preventing movement of the movable section from the use position to the storage position and a released position allowing movement of the movable section from the use position to the storage position, the second pivot axis being parallel with the first pivot axis, wherein the support assembly further comprises a mounting bracket having a first pair of spaced apart flanges and a second pair of spaced apart flanges, the first arm is pivotally coupled to the first pair of flanges, and the latch is pivotally coupled to the second pair of flanges.

9. The apparatus of claim 8, wherein the mounting bracket comprises a plate and the first and second pairs of flanges extend generally parallel to each other and perpendicular from at least a portion of the plate.

10. The apparatus of claim 1, wherein the support assembly further comprises a mounting bracket and a biasing member coupled to the latch to bias the latch toward the latched position.

11. The apparatus of claim 10, wherein the biasing member comprises a spring coupled at one end to the mounting bracket and at the other end to the latch.

12. An apparatus for use with a movable section that is coupled to a structure for movement relative to the structure between a use position and a storage position, the apparatus comprising a support assembly configured to support the movable section in the use position, the support assembly having a first arm and a second arm coupled to the first arm for pivoting movement about a first pivot axis, and a latch coupled to the movable section for pivoting movement about a second pivot axis between a latched position preventing movement of the movable section from the use position to the storage position and a released position allowing movement of the movable section from the use position to the storage position, the second pivot axis being parallel with the first pivot axis, wherein the support assembly further comprises a mounting bracket and a biasing member coupled to the latch to bias the latch toward the latched position, and wherein the latch includes spaced-apart first and second arms, and the biasing member comprises a spring coupled at one end to the mounting bracket and at the other end to at least one of the arms.

13. A lockable support assembly for use with a movable section that is movable between a use position extending from a structure and a storage position, the assembly comprising a first arm pivotally coupled to the movable section, a second arm pivotally coupled to the first arm and pivotally coupled to the structure, and a latch movably coupled to the movable section to move between a latched position and a released position, the latch in the latched position being positioned to engage the first arm when the movable section is moved from the use position to inhibit movement of the movable section to the storage position, the latch in the released position permitting movement of the movable section to the storage position.

14. The assembly of claim 13, further comprising a mounting bracket coupled to the movable section, the mounting bracket includes a first pair of spaced apart flanges and a second pair of spaced apart flanges, the first arm is coupled to the first pair of flanges and the latch is coupled to the second pair of flanges.

15. The assembly of claim 14, wherein the first arm is coupled to the first pair of flanges with a retainer, and the assembly further comprises a spring having a first end coupled to the retainer and a second end coupled to the latch, the spring biasing the latch to the latched position.

16. The assembly of claim 15, further comprising a catch coupled to and projecting from one of the arms, wherein when a user moves the movable section toward the use position, a finger grip of the latch cams against the catch and moves the latch out of the path of the catch until the catch is situated in a notch formed in the latch.

17. The assembly of claim 13, wherein the latch comprises a plate formed to have a first latch arm and a second latch arm generally parallel to the first latch arm, a bight extending between and coupling the first and second latch arms, and at least one of the latch arms having a notch formed therein, the notch bordered by an engagement surface positioned when the latch is in the latched position to engage the first arm to inhibit movement of the support assembly to the storage position.

18. The assembly of claim 17, wherein the first arm includes a catch extending therefrom that moves in a path of movement, and when the latch is in the latched position a portion of the latch is positioned in the path of movement.

19. The assembly of claim 13, wherein the first and second arms include first and second cavity walls cooperating with a cavity bottom to form a cavity in each of the arms, and the first and second cavity walls of the first arm are each pivotally coupled to one of the first and second cavity walls of the second arm.

20. The assembly of claim 19, wherein the first and second cavity walls of the first arm are each formed to include an aperture through which a catch is inserted, the catch ends each extending from one of the cavity walls in generally opposite directions, and the latch includes an engagement surface that engages the ends of the catch to inhibit movement of the movable section to the use position.

21. The assembly of claim 13, wherein the first and second arms include first and second cavity walls cooperating with a cavity bottom to form a cavity in each of the arms, and the assembly further includes a spring to bias the first and second arms toward the use position, the spring coupled at one end to the cavity bottom of the first arm and at the other end to the cavity bottom of the second arm.

22. The assembly of claim 13, wherein the first and second arms pivot relative to one another in a first plane of movement and the latch pivots relative to the movable section in a second plane of movement, the first and second planes being substantially parallel to one another.

23. The assembly of claim 13, wherein the first arm is pivotally coupled to the movable section and pivots relative thereto about a first arm pivot axis, and the latch pivots relative to the movable section about a latch pivot axis, the first arm pivot axis and the latch pivot axis being substantially parallel.

24. A support arm assembly for use with a drop leaf that is movable about a first horizontal axis relative to a base structure between a horizontal use position and a lowered storage position, the assembly comprising a first arm pivoted to the drop leaf, a second arm pivoted to the base structure, the first and second arms being coupled together for pivoting movement about a second horizontal axis, the first and second arms having an in-line configuration to support the drop leaf when the drop leaf is in the use position, the first and second arms having a folded configuration when the drop leaf is in the storage position, a handle grippable to move the first and second arms between the in-line configuration and the folded configuration, a biasing member coupled to the first arm and coupled to the second arm, the biasing member having a longitudinal centerline, the biasing member urging the first and second arms toward the in-line configuration when the second horizontal pivot axis is above the longitudinal centerline, the biasing member urging the first and second arms toward the folded configuration when the second horizontal axis is below the longitudinal centerline, and a latch pivoted to the drop leaf for movement between a latched position in which the latch engages the first arm to prevent the second horizontal pivot axis from moving below the longitudinal centerline and a released position in which the first and second arms are movable from the in-line configuration to the folded configuration.

25. The support arm assembly of claim 24, wherein the latch has a first latch plate and a second latch plate spaced apart from the first latch plate to define an arm-receiving space between the first and second latch plates and the first arm is received in the arm-receiving space when the first and second arms are in the in-line configuration.

26. The support arm assembly of claim 25, wherein the first and second latch plates each have a lower end that is situated below the first arm when the first and second arms are in the in-line configuration.

27. The support arm assembly of claim 25, wherein the latch has a bight coupled to the first and second latch plates and the bight is situated above the first arm when the first and second arms are in the in-line configuration.

28. The support arm assembly of claim 24, further comprising a second biasing member coupled to the latch to bias the latch toward the latched position.

29. The support arm assembly of claim 28, wherein the first arm is formed to include a channel and at least a portion of the second biasing member is situated in the channel when the first and second arms are in the in-line configuration.

30. The support arm assembly of claim 24, wherein the first arm comprises a first member and a catch extending from the first member and wherein the latch engages the catch to prevent the second horizontal axis from moving below the longitudinal centerline of the first biasing member.

31. The support arm assembly of claim 30, wherein the catch comprises a cylindrical pin that extends horizontally from the first member.

32. The support arm assembly of claim 24, further comprising a mounting bracket coupled to the drop leaf; the first arm is coupled to the mounting bracket, and the latch is coupled to the mounting bracket.

33. The support arm assembly of claim 32, further comprising a second biasing member that biases the latch to pivot about a latch pivot axis in a first direction and the latch having a stop edge that engages the mounting bracket under the bias of the second biasing member when the first and second arms are in the folded configuration.

34. The support arm assembly of claim 24, wherein the latch pivots relative to the drop leaf about a latch pivot axis that is parallel to the second horizontal axis.

35. The support arm assembly of claim 24, wherein the first arm is formed to include a first channel, the second arm is formed to include a second channel, a first portion of the biasing member is situated in the first channel and a second portion of the biasing member is situated in the second channel when the first and second arms are in the in-line configuration, and the latch is situated outside the first and second channels.

36. The support arm assembly of claim 24, further comprising a bumper coupled to the second arm and the bumper engaging the base structure when the first and second arms are in the folded configuration.

* * * * *